US007768484B2

(12) United States Patent
Huang et al.

(10) Patent No.: US 7,768,484 B2
(45) Date of Patent: Aug. 3, 2010

(54) AMOLED PANEL

(75) Inventors: Jiunn-Yau Huang, Tainan County (TW); Cheng-Chi Yen, Tainan (TW)

(73) Assignees: Himax Technologies Limited, Tainan County (TW); Himax Display, Inc., Tainan County (TW)

( * ) Notice: Subject to any disclaimer, the term of this patent is extended or adjusted under 35 U.S.C. 154(b) by 743 days.

(21) Appl. No.: 11/802,143

(22) Filed: May 21, 2007

(65) Prior Publication Data

US 2007/0279339 A1 Dec. 6, 2007

(30) Foreign Application Priority Data

Jun. 5, 2006 (TW) ..... 95119832 A

(51) Int. Cl.
*G09G 3/36* (2006.01)

(52) U.S. Cl. ..... 345/76; 345/82; 345/52

(58) Field of Classification Search ..... 345/42–53, 345/76–92, 204; 315/169.1–169.4; 327/246, 327/355

See application file for complete search history.

(56) References Cited

U.S. PATENT DOCUMENTS 4,214,271 A * 7/1980 Jones et al. ..... 348/691
6,486,618 B1 * 11/2002 Li ..... 315/291
6,788,231 B1 * 9/2004 Hsueh ..... 341/135
7,259,521 B1 * 8/2007 Ritter ..... 315/169.1
7,317,326 B2 * 1/2008 Nakano et al. ..... 324/770
7,317,444 B2 * 1/2008 Chang ..... 345/102
2007/0057874 A1 * 3/2007 Le Roy et al. ..... 345/76
2010/0053128 A1 * 3/2010 Shin ..... 345/204

* cited by examiner

*Primary Examiner*—Nitin Patel
(74) *Attorney, Agent, or Firm*—Rabin & Berdo, P.C.

(57) ABSTRACT

An AMOLED panel includes an AMOLED pixel unit, a scan driving unit and a data driving unit. The scan driving unit is coupled to the AMOLED pixel unit. The data driving unit is coupled to the AMOLED pixel unit and a voltage source and includes a switch and a DC-to-AC converter. The switch has a first terminal coupled to the AMOLED pixel unit and a second terminal coupled to the voltage source. The DC-to-AC converter has n+1 bytes, wherein n is a positive integer. The DC-to-AC converter is coupled to a control terminal of the switch and outputs a variable voltage to turn on the switch to make the switch generate a data current. The DC-to-AC converter changes a magnitude of the variable voltage to control a magnitude of the data current.

9 Claims, 4 Drawing Sheets

20

AMOLED PANEL

This application claims the benefit of Taiwan application Serial No. 95119832, filed Jun. 5, 2006, the subject matter of which is incorporated herein by reference.

BACKGROUND OF THE INVENTION

1. Field of the Invention

The invention relates in general to an active matrix organic light emitting diode (AMOLED) panel, and more particularly to an AMOLED panel driven by a large current.

2. Description of the Related Art

In an active matrix organic light emitting diode (AMOLED) display, a number of pixels in an AMOLED panel display an image to be represented generally. The pixels are controlled to emit the luminance required according to a data signal.

FIG. 1 (Prior Art) is a circuit diagram showing a conventional AMOLED panel 10. In the AMOLED panel 10 and in a writing timing stage, a scan signal Scan outputted from a scan driving unit 14 turns on a transistor T1 and a transistor T2 in an AMOLED pixel unit 11. A transistor T3 also generates a current IData according to the current IData possessed by a data driving unit 12. Because the transistor T3 and a transistor T4 form a current mirror circuit structure, the transistor T4 generates a current IOLED in proportional to the current Idata. The current IOLED is outputted to a light emitting diode 16 to make the light emitting diode 16 emit the corresponding luminance. Meanwhile, a capacitor C is also charged to a corresponding voltage level.

Then, in a displaying timing stage, the scan signal Scan turns off the transistor T1 and the transistor T2, so the transistor T4 is electrically isolated from the data driving unit 12. A voltage difference between a source and a gate of the transistor T4 is stably kept at the corresponding voltage level through the capacitor C, and the current IOLED is also stably kept at a predetermined value. However, the magnitude of the current IData, which is driven by the data driving unit 12, is limited, and the area of the data driving unit 12 has to be enlarged if the larger driving current has to be provided. Consequently, the cost is increased.

SUMMARY OF THE INVENTION

The invention is directed to an AMOLED panel utilizing a DC-to-AC converter to provide a larger current to drive AMOLED pixels.

According to the present invention, an AMOLED panel including an AMOLED pixel unit, a scan driving unit and a data driving unit is provided. The scan driving unit is coupled to the AMOLED pixel unit. The data driving unit is coupled to the AMOLED pixel unit and a voltage source and includes a switch and a DC-to-AC converter. The switch has a first terminal coupled to the AMOLED pixel unit, and a second terminal coupled to the voltage source. The DC-to-AC converter has n+1 bytes, wherein n is a positive integer. The DC-to-AC converter is coupled to a control terminal of the switch and outputs a variable voltage to turn on the switch to make the switch generate a data current. The DC-to-AC converter changes a magnitude of the variable voltage to control a magnitude of the data current.

The invention will become apparent from the following detailed description of the preferred but non-limiting embodiments. The following description is made with reference to the accompanying drawings.

DETAILED DESCRIPTION OF THE INVENTION

Figure 1:
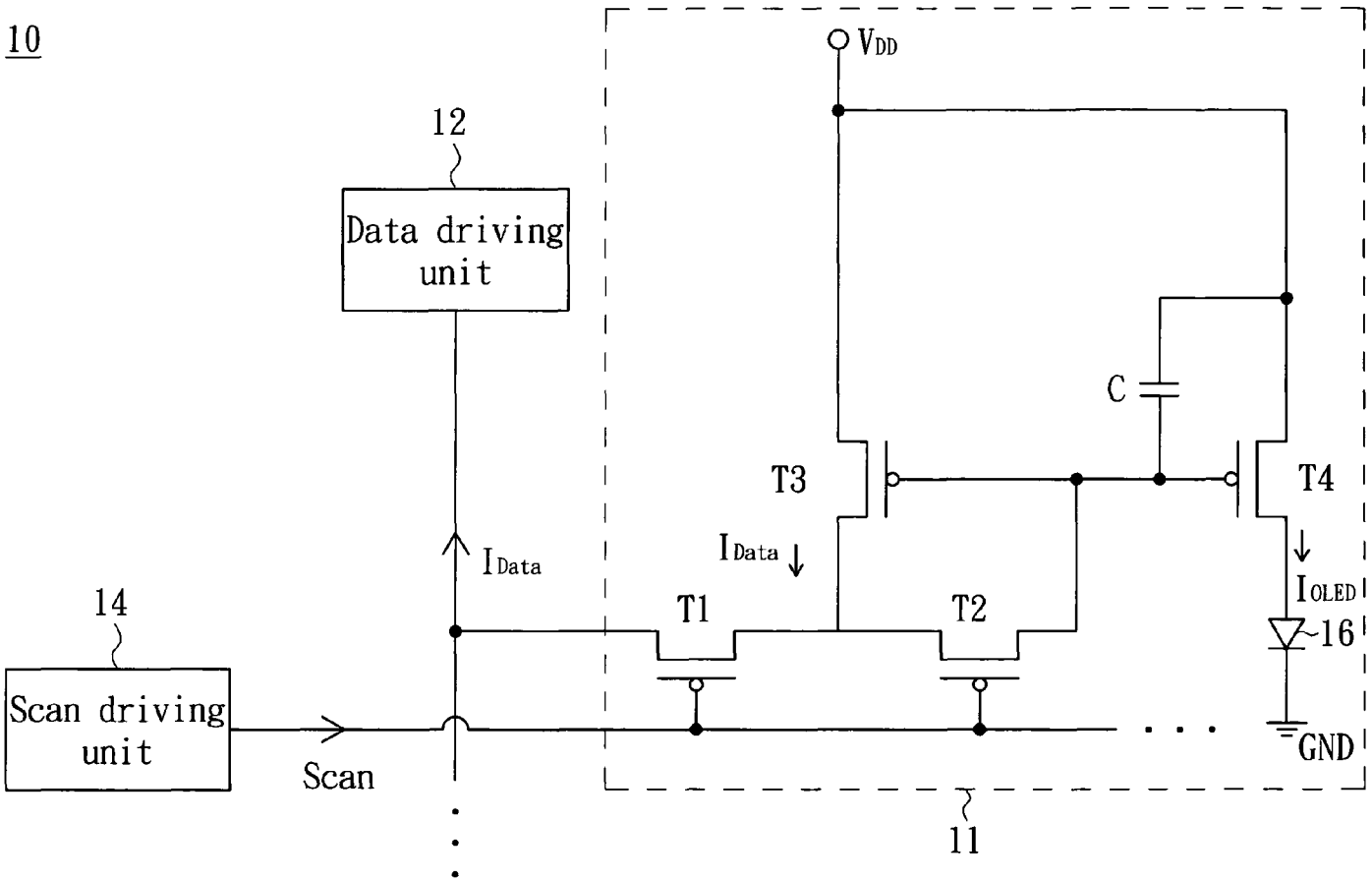
FIG. 1(PRIOR ART)
FIG. 1 (Prior Art) is a circuit diagram showing a conventional AMOLED panel.
Figure 2:
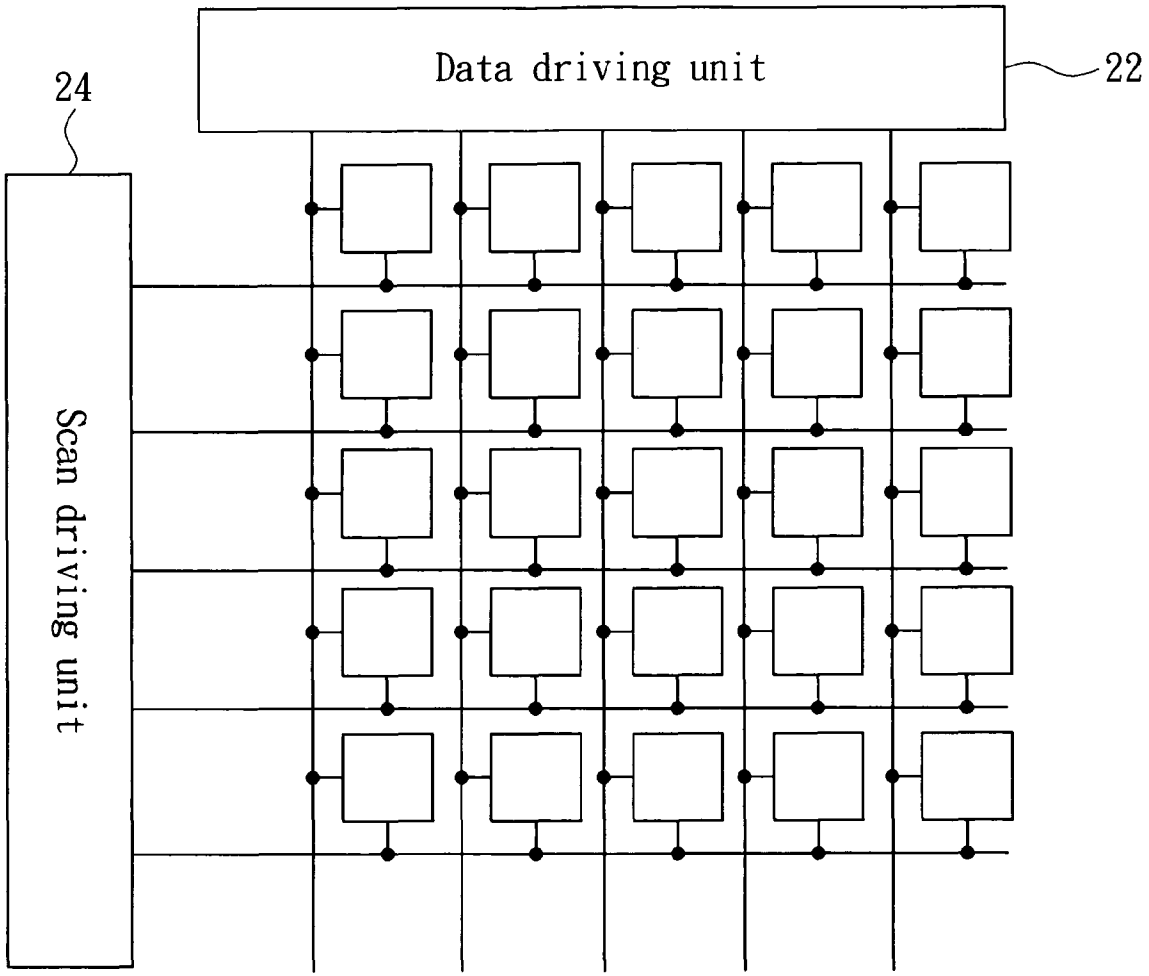
FIG. 2 is a function block diagram showing an AMOLED panel driving circuit 20 according to a preferred embodiment of the invention.

The invention utilizes a DC-to-AC converter to provide a larger current to drive active matrix organic light emitting diode (AMOLED) pixels. FIG. 2 is a functional block diagram showing an AMOLED pixel driving circuit 20 according to a preferred embodiment of the invention. In the AMOLED pixel driving circuit 20, a data driving unit 22 and a scan driving unit 24 respectively control the selected column and row to drive the corresponding AMOLED.

Figure 3:
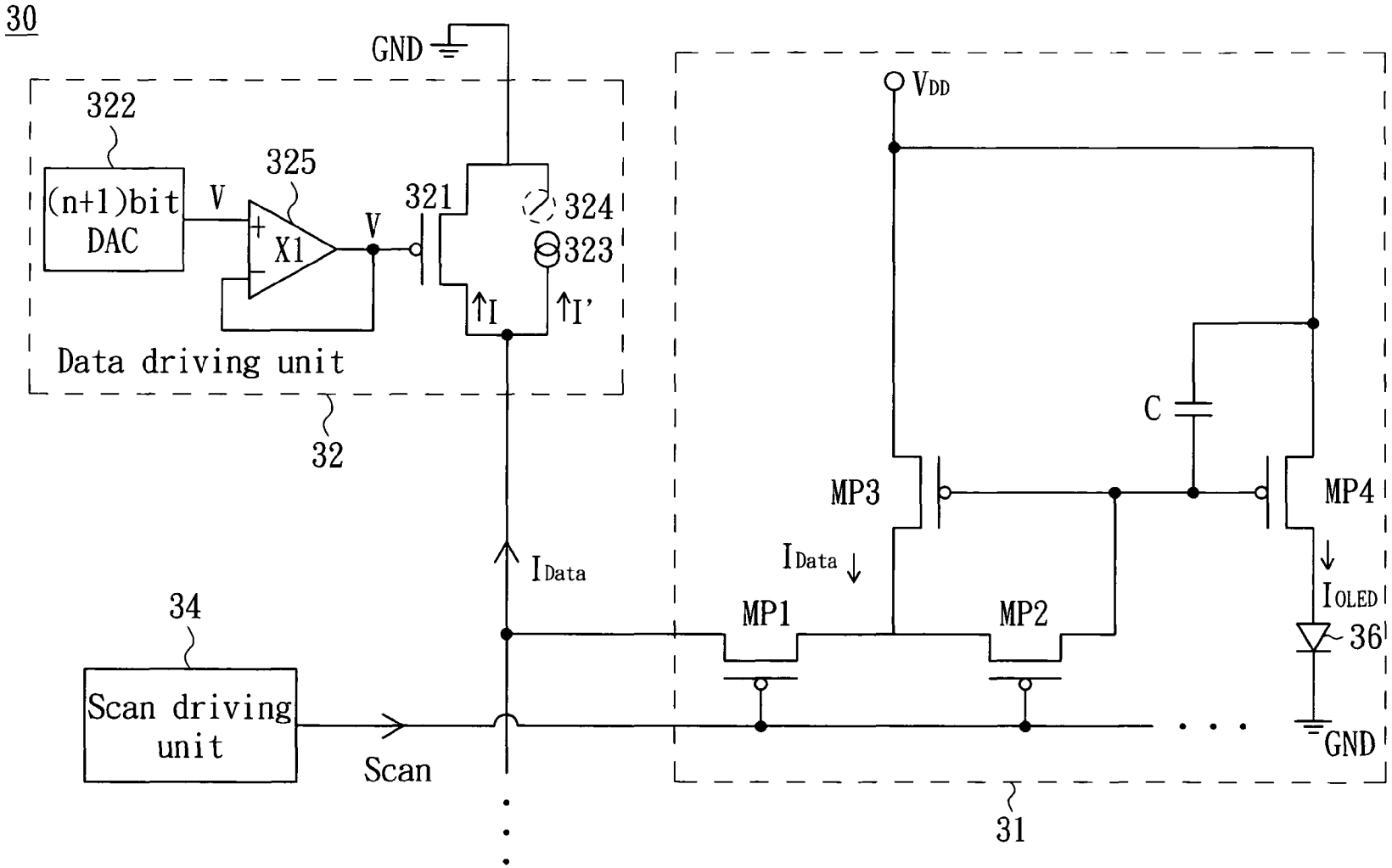
FIG. 3 is a schematic illustration showing the AMOLED panel according to the preferred embodiment of the invention.

FIG. 3 is a schematic illustration showing an AMOLED panel 30 according to the preferred embodiment of the invention. The AMOLED panel 30 includes an AMOLED pixel unit 31, a data driving unit 32 and a scan driving unit 34. The AMOLED pixel unit 31 includes an AMOLED 36, a first switch MP1, a second switch MP2, a third switch MP3, a fourth switch MP4 and an energy storage element C. The first to fourth switches MP1 to MP4 may be PMOS transistors, and the energy storage element C may be a capacitor, for example.

The AMOLED 36 is coupled to a voltage source, such as a ground voltage GND. The transistor MP1 has a first terminal coupled to the data driving unit 32, and a control terminal coupled to the scan driving unit 34. The transistor MP2 has a first terminal coupled to a second terminal of the transistor MP1, and a control terminal coupled to the scan driving unit 34. The transistor MP3 has a first terminal coupled to the first terminal of the transistor MP2, a second terminal coupled to a first voltage, such as an operation voltage VDD, and a control terminal coupled to a second terminal of the transistor MP2. The transistor MP4 has a first terminal coupled to the AMOLED 36, a second terminal coupled to the operation voltage VDD, and a control terminal coupled to the control terminal of the transistor MP3. The capacitor C has a first terminal coupled to the control terminal of the transistor MP4, and a second terminal coupled to the second terminal of the transistor MP4.

In a writing timing stage, a scan signal Scan outputted from the scan driving unit 34 turns on the transistor MP1 and the transistor MP2. The transistor MP3 also generates a current IData according to the current IData possessed by the data driving unit 32. Because the transistor MP3 and the transistor MP4 form a current mirror circuit structure, the transistor MP4 generates a current IOLED in proportional to the current IData, and outputs the current IOLED to the active matrix light emitting diode 36 to make the active matrix light emitting diode 36 emit the corresponding luminance. Meanwhile, the capacitor C is also charged to a corresponding voltage level.

Then, in a displaying timing stage, the scan signal Scan turns off the transistor MP1 and the transistor MP2, so the transistor MP4 is electrically isolated from the data driving unit 32. A voltage difference between a source and a gate of the transistor MP4 is stably kept at the corresponding voltage level through the capacitor C, and the current IOLED is thus stably kept at a predetermined value.

In the AMOLED panel 30, the data driving unit 32 includes a switch 321, a DC-to-AC converter 322, a mirror output circuit 323, a mirror switch 324 and a buffer amplifier 325. The switch 321 has a first terminal coupled to the AMOLED pixel unit 31, and a second terminal coupled to the voltage source GND. The mirror output circuit 323 has a first terminal coupled to the switch 321. The mirror switch 324 has a first terminal coupled to a second terminal of the mirror output circuit 323, and a second terminal coupled to the voltage source GND. The buffer amplifier 325 has an output terminal coupled to the control terminal of the switch 321, a positive input terminal coupled to the DC-to-AC converter 322, and a negative input terminal coupled to the output terminal of the buffer amplifier 325.

The DC-to-AC converter 322 outputs a variable voltage V. Because the DC-to-AC converter 322 has n+1 bytes, the number of magnitude changes of the variable voltage V is $2^{n+1}$, wherein n is a positive integer. The buffer amplifier 325 amplifies the power of the DC-to-AC converter 322, and still outputs the variable voltage V after receiving the variable voltage V. The variable voltage V turns on the switch 321 to make the switch 321 operate in a linear operation region. Then the switch 321 outputs a data current I having a magnitude in directly proportional to a magnitude of the variable voltage V.

When the mirror switch 324 is turned on, the mirror output circuit 323 outputs a duplicated data current I', which is proportional to the data current I. For example, I'=I. Thus, the magnitude of the current IData drafted from the data driving unit 32 by the AMOLED pixel unit 31 is the sum (i.e., 2I) of the data current I and the duplicated data current I'.

The position of the mirror switch 324 may also be changed. For example, the first terminal of the mirror switch 324 may be coupled to the mirror output circuit 323, and the second terminal of the mirror switch 324 is coupled to the AMOLED pixel unit 31.

Figure 4:
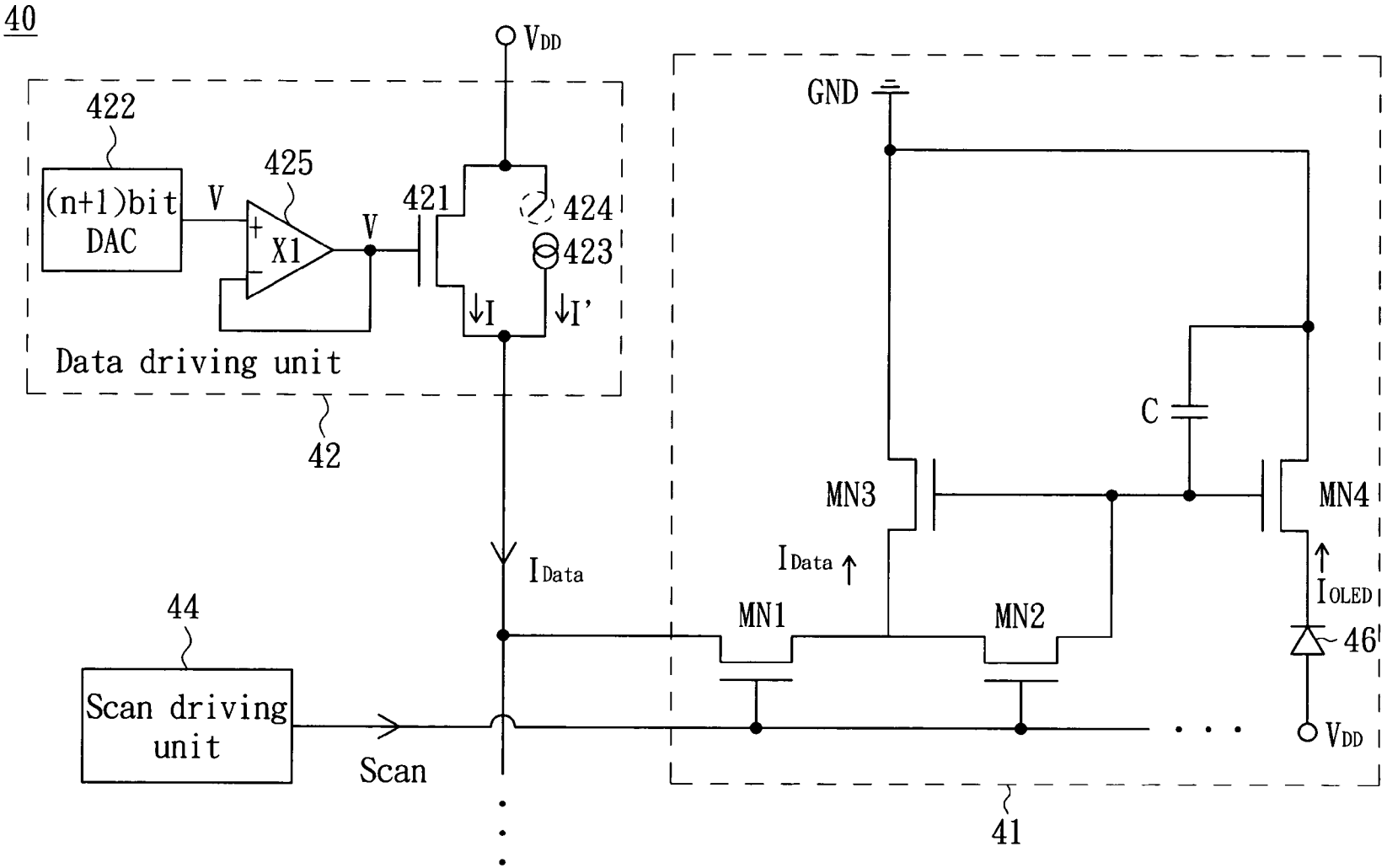
FIG. 4 is a circuit diagram showing an example of another AMOLED panel according to the preferred embodiment of the invention.

In the AMOLED panel 30, the first to fourth switches may also be NMOS transistors. FIG. 4 is a circuit diagram showing another example of another AMOLED panel 40 according to the preferred embodiment of the invention. Referring to FIG. 4, a transistor MN3 has a first terminal coupled to a first terminal of a transistor MN2, a second terminal coupled to the ground voltage GND, and a control terminal coupled to a second terminal of the transistor MN2 in the AMOLED panel 40. A transistor MN4 has a first terminal coupled to an AMOLED 46, a second terminal coupled to the operation voltage VDD, and a control terminal coupled to the control terminal of the transistor MN3. The capacitor C has a first terminal coupled to the second terminal of the transistor MN4, and a second terminal coupled to the second terminal of the transistor MN4. In addition, a data driving unit 42 is coupled to the operation voltage VDD.

The operational principle of the AMOLED panel 40 is the same as that of the AMOLED panel 30, and one of ordinary skill in the art may make any modification easily. So, detailed descriptions thereof will be omitted.

The AMOLED panel according to the embodiment of the invention utilizes a DC-to-AC converter to provide a larger current to drive the AMOLED pixels, and also to provide various currents with different magnitudes to drive the AMOLED pixels.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An active matrix organic light emitting diode (AMOLED) panel, comprising:

an AMOLED pixel unit;

a scan driving unit coupled to the AMOLED pixel unit; and a data driving unit coupled to the AMOLED pixel unit and a voltage source, wherein the data driving unit comprises:

a switch having a first terminal coupled to the AMOLED pixel unit, and a second terminal coupled to the voltage source; and a DC-to-AC converter having n+1 bytes, wherein n is a positive integer, the DC-to-AC converter is coupled to a control terminal of the switch and outputs a variable voltage to turn on the switch to make the switch generate a data current, and the DC-to-AC converter changes a magnitude of the variable voltage to control a magnitude of the data current.

2. The AMOLED panel according to claim 1, further comprising:

a mirror output circuit, which is coupled to the switch, for outputting a duplicated data current to the AMOLED pixel unit, wherein the duplicated data current is proportional to the data current; and a mirror switch for controlling the duplicated data current to output the AMOLED pixel unit or not.

3. The AMOLED panel according to claim 2, wherein the mirror switch has a first terminal coupled to the voltage source, and a second terminal coupled to the mirror output circuit.

4. The AMOLED panel according to claim 2, wherein the mirror switch has a first terminal coupled to the mirror output circuit, and a second terminal coupled to the AMOLED pixel unit.

5. The AMOLED panel according to claim 1, further comprising a buffer amplifier for amplifying a power of the DC-to-AC converter, wherein the buffer amplifier has a positive input terminal coupled to the DC-to-AC converter, an output terminal coupled to the control terminal of the switch, and a negative input terminal coupled to the output terminal of the buffer amplifier.

6. The AMOLED panel according to claim 1, wherein the AMOLED pixel unit comprises:

an AMOLED coupled to the voltage source;

a first switch having a first terminal coupled to the data driving unit, and a control terminal coupled to the scan driving unit;

a second switch having a first terminal coupled to a second terminal of the first switch, and a control terminal coupled to the scan driving unit;

a third switch having a first terminal coupled to the first terminal of the second switch, a second terminal coupled to a first voltage, and a control terminal coupled to the second terminal of the second switch;

a fourth switch having a first terminal coupled to the AMOLED, a second terminal coupled to the first voltage, and a control terminal coupled to the control terminal of the third switch; and an energy storage element having a first terminal coupled to the control terminal of the fourth switch, and a second terminal coupled to the second terminal of the fourth switch.

7. The AMOLED panel according to claim 6, wherein the energy storage element is a capacitor.

8. The AMBLED panel according to claim 6, wherein the switch, the first switch, the second switch, the third switch and the fourth switch are PMOS transistors, the voltage source outputs a ground voltage, and the first voltage is an operation voltage.

9. The AMOLED panel according to claim 6, wherein the switch, the first switch, the second switch, the third switch and the fourth switch are NMOS transistors, the voltage source outputs an operation voltage, and the first voltage is a ground voltage.

* * * * *